United States Patent [19]

Kochendorfer et al.

[11] 3,968,906

[45] July 13, 1976

[54] RAM FOR ICE DISPENSING DEVICE

[75] Inventors: Donald P. Kochendorfer; Robert S. Hanson, both of Dayton, Ohio

[73] Assignee: General Motors Corporation, Detroit, Mich.

[22] Filed: May 8, 1975

[21] Appl. No.: 575,588

[52] U.S. Cl. ..... 222/243; 222/409

[51] Int. Cl.[2] ..... G01F 11/00

[58] Field of Search ..... 222/199, 200, 226, 232, 222/233, 234, 243–248, 409; 62/344

[56] References Cited

UNITED STATES PATENTS

| | | | |
|---|---|---|---|
| 1,914,209 | 6/1933 | Lambert | 222/243 |
| 2,807,394 | 9/1957 | Bedard | 222/243 |
| 3,021,035 | 2/1962 | Hill | 222/245 |
| 3,887,119 | 6/1975 | Sucro et al. | 222/247 |

*Primary Examiner*—Robert B. Reeves
*Assistant Examiner*—Francis J. Bartuska
*Attorney, Agent, or Firm*—Edward P. Barthel

[57] ABSTRACT

An ice piece dispenser comprising a storage container having a longitudinally extending trough in its bottom wall with an ice dispensing closure means at the front end of the trough. A motor driven ram is positioned in the trough for combined reciprocating and oscillating travel wherein the ram has a stepped upper surface with a vertically extending ice piece agitating fin member formed integrally on one of the ram steps. The fin member is operative, in conjunction with the container's sloped front wall chute, to break-up ice piece clusters upon the forward thrust of the ram and whereby the ice pieces exert a downward gravitational force on inclined edges of the fin to maintain the ram in sliding contact with the trough base during its forward thrust.

1 Claim, 4 Drawing Figures

RAM FOR ICE DISPENSING DEVICE

This invention relates to ice piece dispensing containers for automatic ice makers and is directed to an improved ice piece storage and dispensing container having an ice piece agitating fin member integrally formed on one of the stepped surfaces of an eccentrically driven ram.

The U.S. Patent application Ser. No. 420,361 filed Nov. 30, 1973, now U.S. Pat. No. 3,887,119 for Ice Dispensing Device With Oscillating Ram, discloses a unique storage and dispensing apparatus for use with an automatic ice maker. Although the ice piece dispensing ram of the above-identified patent application incorporates an agitating motion during its ice advancing stroke operative to break up most ice clumps or clusters stored within the container, it has been found that under certain conditions it is necessary to have additional agitating means operative in conjunction with a vertically oriented chute arrangement formed in the container sloped front wall to enable the dispenser to break up two interconnected or fused ice pieces called a webbed double that become caught at the front of the container blocking the entrance of other ice pieces into the chute.

It is accordingly an object of the present invention to provide an improved ice piece storage and dispensing container having an eccentrically driven ram member disposed in a longitudinally extending trough located in the bottom of the container with the ram having a stepped upper surface together with a vertically extending fin member on one of the steps operative in conjunction with the forward stroke of the ram to break up ice clusters. The ice pieces collected in the container exert a vertically downward gravitational component of force on the fin sloped edges and tapered sides to maintain the ram in sliding contact with the trough base during its oscillating movement.

Further objects and advantages of the present invention will be apparent from the following description, reference being had to the accompanying drawings, wherein a preferred embodiment of the present invention is clearly shown.

Figure 1:
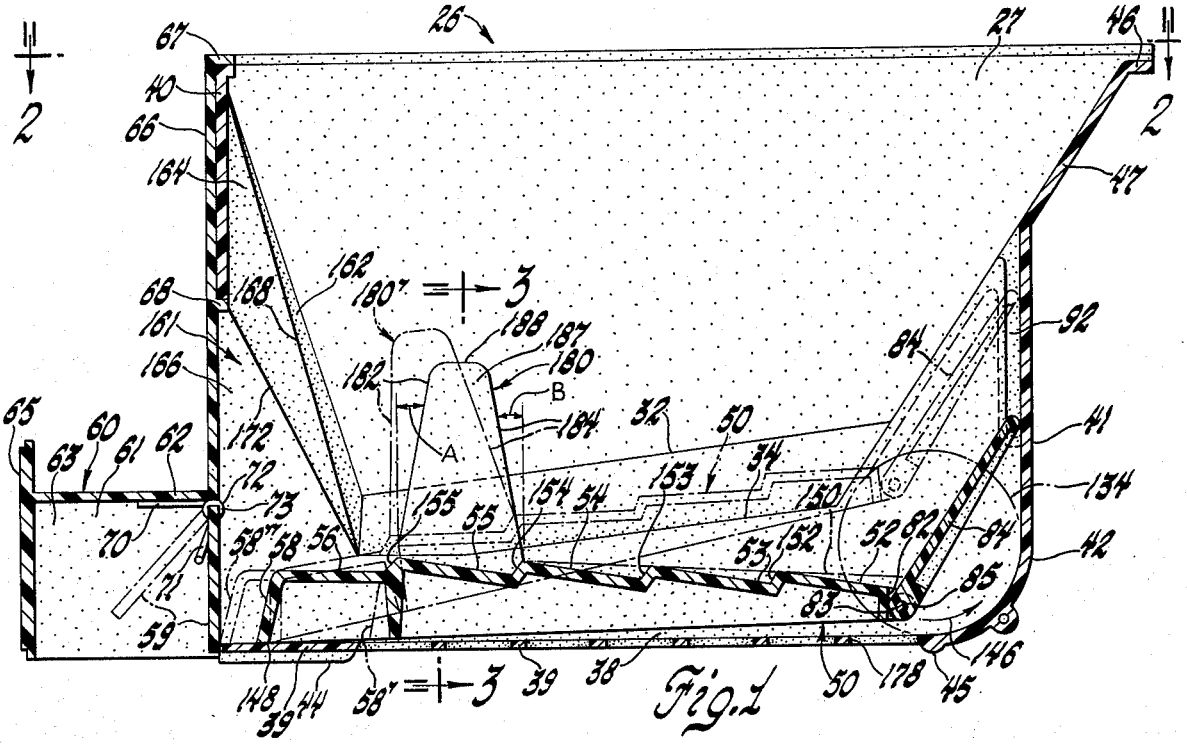
FIG. 1 is a vertical longitudinal sectional view of the ice dispensing means of the present invention designed for use in the freezer compartment of a household refrigerator.
Figure 2:
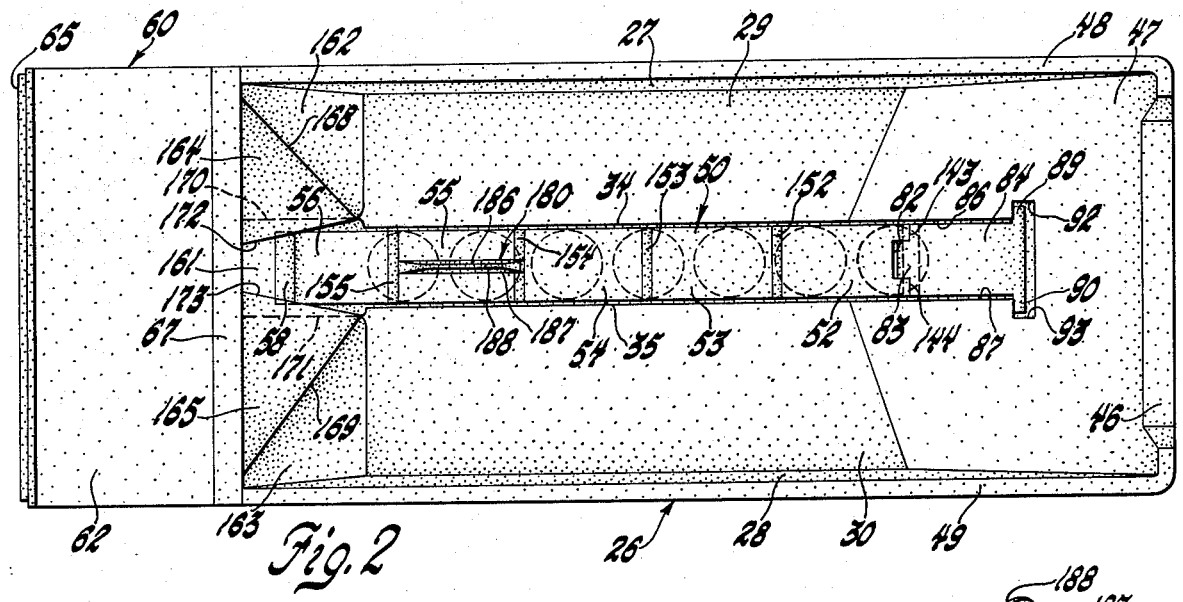
FIG. 2 is a top plan view of the storage and dispensing bin taken on the line 2—2 of FIG. 1.

Referring now to the drawings there is shown in FIGS. 1 and 2 an ice piece storage and dispensing container or bin, generally indicated at 26, designed to be removably supported on a support shelf of a freezer compartment of a domestic refrigerator as shown and described in the above-mentioned U.S. Patent application Ser. No. 420,361 which is assigned to the same assignee as the instant application the disclosure of which is incorporated by reference herein.

The storage bin has a generally box-shaped configuration including vertical side walls 27 and 28. The base portion of the bin includes downwardly and inwardly converging bottom walls 29 and 30 (FIG. 3) defined at their outer edges by forwardly sloped parallel corner junctures 32 and 33 formed at the intersection with the respective side walls 27 and 28 with the walls 29 and 30 defined at their inner edges by corner junctures 34, 35 formed with the intersection of side plates 36 and 37, respectively, of a longitudinally extending bin trough 38. The junctures 34 and 35 are forwardly and downwardly sloped so as to be substantially parallel to the respective junctures 32 and 33, as seen in FIG. 1 for junctures 32 and 34, such that each of the bottom walls 29, 30 are both forwardly and inwardly sloped in a compound manner.

The trough 38 is closed at its underside by a bottom plate or base 39 which is rearwardly spaced from the bin front wall 40 while the plate 39 merges with trough rear wall 41 via arcuate fillet 42. The bin includes a rear lip flange 46 on sloping rear wall 47 and side lip flanges 48 and 49. It will be noted that the bin side walls 27, 28 terminate at their forward ends in bottom longitudinal edge portion 44 which together with a transversely extending skid 45 supports the bin on the refrigerator freezer shelf on a work surface when removed from the refrigerator. The bin is preferably integrally molded from a suitable plastic material which in the disclosed form is ABS plastic.

The trough 38 has positioned therein an elongated ram member 50, molded from a plastic material such as Nylon, whose upper surface has a plurality of steps which, as seen in FIG. 1, have their surfaces located in substantially parallel planes indicated by the numerals 52, 53, 54 and 55 such that the step surfaces are inclined rearwardly when the ram 50 is located in its solid line position within the trough 38 and the trough defining junctures 34 and 35. The ram lead or forwardmost step, shown having a lesser rearwardly inclined face 56 in the ram's solid line position, terminates in a downwardly and forwardly sloping ram front face 58. The ram face 58 is shown rearwardly spaced from a pivoted closure means in the form of a trap door 59 pivotally mounted at the entrance to an ice piece discharge housing member 60. The member 60 provides an ice piece discharge compartment 61 defined by an upper wall 62, opposed side partitions one of which is shown at 63, and a front baffle wall 65 forwardly offset from a front cover plate 66 having a return flanged hook 67 and rib 68 dimensioned to engage the top and bottom edges respectively of front wall strip 40, together with side wall engaging prongs and slots (not shown).

The closure member or door 59 is normally biased closed by suitable spring means such as a mousetrap spring having its arms shown at 70 and 71 with its helical coil indicated at 72 formed around one of the door integral pin members 73 which extend outwardly from the door side edges pivotally engaging suitable apertures in the housing side walls 63 to pivot the trap door 59 outwardly to an open position indicated by dashed lines in FIG. 1 upon ice pieces being advanced thereagainst by the ram front face 58 in a manner to be explained.

As seen in FIG. 2, the rearward or aft portion of the ram 50 is notched at 82 to provide a bifurcated end for the reception of a tongue 83 integral with the forward drive end of a blade-shaped linking member 84 to provide a hinge connection with the ram and being pivotal about transverse link or hinge pin 85 (FIG. 1). The linkage member 84 is dimensioned so as to be movable in the container vertical slot defined between the upper wall portions 86 and 87 which, as seen in FIG. 3, are coplanar with the rough walls 36 and 27 respectively.

The rearmost portion of linkage member 84 includes outwardly extending integral guide pins 89 and 90 for sliding reception in opposed verticl guide slots 92 and 93 respectively, formed in the rear wall portions 86 and 87.

As explained in the Sucro et al patent application Ser. No. 420,361 now U.S. Pat. No. 3,887,119 to effect a combined reciprocating and oscillating movement of the ram 50, the linkage member 84 is driven by eccentric drive means in the form of a small fractional horsepower electrical motor (not shown) preferably located in the rear wall of the freezer compartment which motor has its motor shaft coupled by axially separable driving connection means preferably in the form of resilient helical coil coupling means shown and described in U.S. Patent application Ser. No. 498,755 Fogt, now U.S. Pat. No. 3,930,380, and entitled Ice Dispenser Container Coupling, filed Aug. 19, 1974, and assigned to the same assignee as the instant application.

Figure 3:
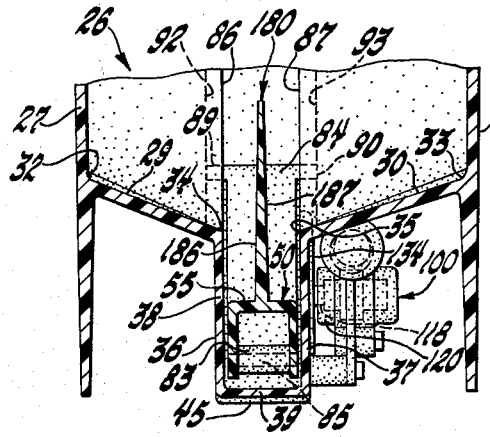
FIG. 3 is a fragmentary vertical transverse sectional view taken substantially on the line 3—3 of FIG. 1.

As seen in FIG. 3, a reduction gear unit casing 100 is secured to the rear portion of the trough side plate 37 by suitable machine screws (not shown). As seen in the Sucro et al Patent application, a driven coupling shaft extends through the wall of the casing 100 of the reduction gear unit and engages suitable bearing cups located in the end walls of the casing 100. Suitable connecting means such as a worm on the coupling shaft and a worm gear secured to transverse shaft 118 extending through an opening in the opposite casing side wall 120 suitably connected to drive wheel 134 (FIG. 1) to which hinge pin 85 is eccentrically connected adjacent the outer periphery of the drive wheel. The drive wheel 134, integrally formed on the inner end of transverse shaft 118, is rotated within a conforming circular opening in the trough side plate 37 while the drive wheel 134 has its inner surface flush therewith. The link or hinge pin 85 is received in journalled fashion in a bore located adjacent the outer periphery of the drive wheel 134 for reception through the aligned apertured tongue 83 of the linkage member 84 and bifurcated fingers 143 and 144 of the ram 50.

A suitable on-off push-button motor actuator, preferably located in a refrigerator exterior service area as shown for example in U.S. Pat. No. 3,789,620, issued Feb. 5, 1974 to Benasutti, et al, and assigned to the same assignee as the present application, may be manually operated by holding the button in by finger pressure to initiate the operation of the dispenser.

As set forth in the mentioned Benasutti Patent application Ser. No. 420,361, now U.S. Pat. No. 3,887,119, upon the drive wheel 134 being rotated in a counterclockwise direction, indicated by arrow 146 in FIG. 1, the eccentric motion imparted by pin 85 results in a combined reciprocating and oscillating movement of the ram 50. Such movement causes the ram to be initially moved forward in the trough 38, with its forward front edge 148 in tracking contact with the trough base 39, wherein the ram 50 stepped upper surface moves upwardly out of the trough 38 and into the bin lifting and agitating the ice pieces stored therein as described in the Benasutti et al Patent application Ser. No. 420,361, now U.S. Pat. No. 3,887,119. Under certain conditions, however, this agitation was not able to separate all the ice pieces. Such a condition occurs, for example, when ice pieces were stored over an extended period of time resulting in clusters with ice pieces being "bridged" or frozen to adjacent ice pieces which may occur even though the ice pieces are constantly maintained at a below-freezing temperature within the freezer compartment.

As best seen in FIG. 1, it will be noted that the rearwardly and downwardly sloped position of the stepped ram 50 in its solid line position below the trough upper junctions 34 and 35 is such that an imaginary line connecting the crests of the stepped upper ram surface slopes rearwardly and downwardly at a negative angle of about 4° from the horizontal, as indicated by dashed line 150. As the eccentric drive means moves the ram 50 to its upper broken-line position, the ram is rearwardly reciprocated or withdrawn through its rearwardmost position shown by the dashed line position of the ram front face 58'. An imaginary line connecting the crests of the steps 52–55 in their uppermost position is now sloped forwardly and downwardly at a positive angle which, as shown in FIG. 2, is about 9° from the horizontal with the steps 52–56 moved out of the trough 38 to a position above the trough upper junctures 34 and 35.

As seen in FIG. 1, the trough delimiting junctures 34 and 35 are forwardly and downwardly sloped at an angle from the horizontal of about 7¼°. The result is that as the ram 50 passes through its rearwardmost position 58' and begins its forward thrust elliptical-like motion the first portion of the ram to move upwardly into the bin through the plane of the junctures 34 indicated by juncture 34, is the forwardmost riser 155 of step 55. The riser 155 is thus the first portion of the ram to engage an overlying ice piece and impart initial forward movement thereto. As the ram continues to be moved forward the riser 154 next moves above the juncture 34 to engage and forwardly advance another ice piece and so forth until the risers 153 and 152 successively move above the juncture 34 and in turn engage and forwardly advance ice pieces in the rearward portion of the bin. After the riser 152 merges above juncture 34 it will be seen that the blade or linkage member 84 has moved to its uppermost position, shown by dashed lines at 84' in FIG. 1, and that further rotation of the drive wheel 134 causes the blade 84 to exert a forward thrust or push on any ice pieces located in the blade operating groove defined between the upper wall portions 86 and 87. It will thus be appreciated that because of the foregoing arrangement the ice pieces in the bin will be successively advanced and agitated by the compound motion of the stepped ram operating in conjunction with the bin and trough.

The compound oscillating and reciprocating motion of the ram 50 results in the ice pieces being advanced by the ram steps to a location adjacent opposed substantially mirror image symmetrical pairs of triangular sloped front wall portions 162, 163; 164, 165, and 166, 167. As seen in FIGS. 1 and 2 the initial paired front wall portions 162, 164 and 163, 165 define downwardly converging wall junctures 167 and 168 and 169 respectively providing a lead-in entrance to a downwardly diverging vertically oriented ice piece feed passage or chute 161 of the bin operative for funneling or channeling the ice pieces onto the forward end portion of the trough base. The forward ice piece receiving end of the trough has its side walls 34 and 35 offset outwardly as seen at 170 and 171 respectively to insure an adequate area for receiving the ice pieces. As best seen in FIG. 2, the chute has its opening defined by the downwardly and rearwardly diverging corner junctures 172 and 173 which provide a gradually increasing chute cross section as they approach the trough base 39. In this manner when the bin has a substantial quantity of ice pieces which tend to accumulate or pile up between the front wall triangular portions, the chute 161 permits only the lowermost ice piece or pieces to be admitted and slide downwardly onto the trough base 39 between walls 170 and 171 when the ram front face 58 is in its rearmost or retracted position indicated by ram forward face 58' in FIG. 1.

In this way an ice piece on the forwardmost ice piece engaging means in the form of step 56 is left unsupported by the retraction or rearward travel of the ram causing the ice piece to fall under the influence of gravity into the chute 161 and thence downwardly onto the trough base 39, placing the ice piece in axial alignment with the ram so as to be engaged by its front face 58 during forward travel thereof and pushed outwardly against the trap door 59 causing the door 59 to swing outwardly to an open ice dispensing position indicated by its phantom line location in FIG. 1. As the ram 50 is reciprocated to its forwardmost position, with its front face indicated by phantom lines 58'', the ice pieces push through the front opening into housing cavity 61. In the disclosed embodiment the ice piece is then allowed to fall into a passage in the refrigerator partition as disclosed in the mentioned U.S. Patent for dispensing into a through-the-door ice service area in the outer face of the refrigerator cabinet such as a lower fresh food access door (not shown). It is to be understood that applicant's improved ice bin may be used with other styles of refrigerator cabinet ice dispensing arrangements such as a side-by-side refrigerator, while it may also be used with refrigerators which dispense ice internally.

It will be appreciated that the ram 50 is dimensioned to be snugly received in the trough 38 and has such a height relative to the trough that in its rearward travel the ice engaging means or steps are moved out of the bin and downward into the trough so as to be free of contact with the ice pieces. To prevent the possibility of ice chips or flakes from clogging the free travel of ram 50 the trough base 39 is provided with a plurality of apertures 178 to allow any ice chips to fall therethrough and maintain the trough in an unobstructed condition.

Applicant's present invention provides an improved ice dispenser storage bin wherein the clusters of ice pieces may be effectively broken-up during ram agitation by means of a vertically extending fin member formed on one of the ram's stepped surfaces as shown by the fin member generally indicated at 180. In the preferred form the fin member 180 is located on the second or penultimate stepped surface 55 of the ram 50 such that its base portion extends longitudinally the full dimension of the step 55. As depicted in its full-line partially retracted or intermediate position in FIG. 1, the fin member 180 has its leading edge 182 rearwardly and upwardly sloped or canted from the fin base at its juncture with the leading transverse edge or crest of step 55 at a predetermined angle with the vertical defining a leading pitch angle "A" of about 11°. The rear or trailing edge 184 of the fin is forwardly and upwardly sloped from the fin base at its juncture with the transverse edge or crest of stepped surface 54 at a predetermined angle with the vertical defining a trailing pitch angle "B" of about 14°. By virtue of applicant's novel fin design it will be seen that during both rearward and forward travel of the ram 50 both the leading and trailing edges 182 and 184 respectively of the fin member will always be at a sloped orientation relative to the vertical. The purpose of the fin sloped edges 182, 184 is to utilize the vertical component of force exerted by the stored ice pieces on the fin edges to maintain the ram forward edge 148 in sliding contact or engagement with the trough base. It will be noted in FIG. 1 that the leading edge 182 has a lesser slope angle A than the trailing edge slope angle B to allow the edge 182 to approach within about 2° to the vertical, when in its dashed line forwardmost position. This near vertical position of the edge 182 enables the fin member 50 to more readily break apart fused clusters of cubes that become trapped between the fin member and the front wall chute 161.

Figure 4:
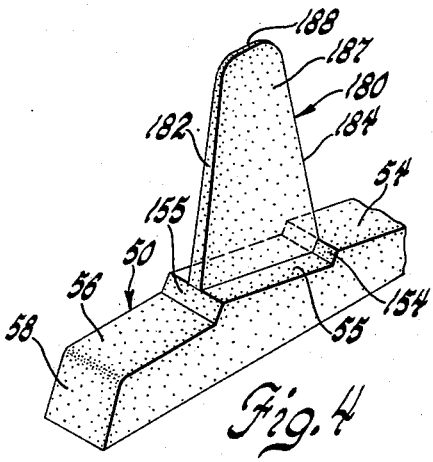
FIG. 4 is a fragmentary perspective view of the forward portion of the ram and vertical fin assembly.

As best seen in FIGS. 2–4, it will be noted that the fin member 180 is generally wedge-shaped in vertical section such that its side walls or surfaces 186 and 187 converge upwardly from its base step surface 55 to its uppermost rounded top edge 188. It will be appreciated that applicants' single fin member 180 will offer a minimum of resistance to initial sliding motion relative to the stored ice pieces in the bin upon the ram drive motor being energized at start-up.

The fact that the leading 182 and trailing 184 edges of the fin member 50 are sloped as described allows them to be operative to lift any ice pieces above and around the fin member thereby assisting the ice pieces in beings properly oriented for movement into the ice piece chute 161. In addition the taper of the fin side walls 186 and 187 are also operative to develop a resultant downward vertical component of force exerted by the ice cubes or pieces to assist in maintaining the ram forward edge 148 in contact with the trough base 39.

It will be noted that in the preferred embodiment the fin member 180 is of a thickness relative to said ram 50 such that at its base the fin member is about one-fifth the overall width of the ram. Thus, in the form shown the ram has a width of about one inch and the ram base has a thickness of about 0.20 inches.

While the embodiment of the present invention as herein disclosed constitutes a preferred form, it is to be understood that other forms might be adopted.

We claim:

1. An ice piece dispenser comprising a container for receiving and collecting ice pieces, said container including a front wall with a vertically extending chute formed therein communicating with a dispensing opening in said front wall, a longitudinally extending trough formed in the bottom wall of said container with said trough having a planar horizontally disposed base, the forward portion of said trough being subjacent to said chute so as to receive ice pieces therefrom, an elongated ram positioned in said trough, said ram having a forward end face with its lower edge supported on said trough base for reciprocal movement thereon, said ram having its rearward end secured by a pivotal connection to eccentric drive means for movement of said pivotal connection in a circular path, a plurality of steps formed on the upper surface of said ram, whereby eccentric movement of said pivotal connection, through rotation of said drive means, will cause said ram forward end face to move forwardly and rearwardly in a substantially horizontal path in said trough, such that an imaginary line connecting the leading edges of said steps is inclined rearwardly and downwardly when said ram is in an intermediate position, wherein the improvement comprising a vertically extending ice piece agitating fin member formed on the penultimate one of said ram steps, said fin member having a leading edge sloped rearwardly and upwardly from its base, said fin member having a trailing edge sloped forwardly and upwardly from its base, such that upon said ram being reciprocated to its forwardmost position said leading edge approaches a vertical orientation, said trailing edge slope being greater than said leading edge slope when said ram is in its intermediate position, said fin member extending the full longitudinal distance of said penultimate step, said fin member having its side walls converging upwardly from said ram in wedge shape fashion, whereby said fin member leading edge is operative in conjunction with said container front wall chute to break-up ice piece clusters upon the forward thrust of the ram, and whereby the ice pieces collected in said container being operative to exert a vertically downward component of force on said fin sloped edges and side walls to maintain said ram face lower edge in contact with the said trough base during the forward thrust of said ram.

* * * * *